United States Patent [19]

Sando et al.

[11] Patent Number: 4,607,508

[45] Date of Patent: Aug. 26, 1986

[54] APPARATUS FOR APPLYING TREATING SOLUTION TO A CLOTH IN CONTINUOUS TREATMENT OF THE CLOTH

[75] Inventors: Yoshikazu Sando; Hiroshi Ishidoshiro, both of Wakayama, Japan

[73] Assignee: Sando Iron Works, Ltd., Japan

[21] Appl. No.: 660,842

[22] Filed: Oct. 12, 1984

[30] Foreign Application Priority Data

Oct. 18, 1983 [JP] Japan ..... 58-194758
Nov. 14, 1983 [JP] Japan ..... 58-213696

[51] Int. Cl.[4] ..... B05C 3/132

[52] U.S. Cl. ..... 68/22 R; 68/62; 68/158; 68/175; 118/419; 118/421

[58] Field of Search ..... 118/419, 421, 70, 426; 68/22 R, 62, 158, 175, 212

[56] References Cited

U.S. PATENT DOCUMENTS 3,150,996 9/1964 Johnson ..... 118/421 X
3,285,225 11/1966 Recor ..... 118/421 X
3,334,611 8/1967 Nechrony et al. ..... 118/70

*Primary Examiner*—John P. McIntosh
*Attorney, Agent, or Firm*—Wenderoth, Lind & Ponack

[57] ABSTRACT

An apparatus for applying a treating solution to a cloth during the continuous treatment thereof, comprising: a cloth guide drum for transporting and guiding a cloth to be treated; a movable treating solution tank provided in close proximity to the circumference of the lower half of the cloth guide drum thus forming a cloth passage of a narrow width therebetween; a cylinder for raising and lowering of the movable treating solution tank; a treating solution supply pipe for supplying a treating solution continuously to the cloth passage; and wash-water jet nozzles for propelling wash water to the inner surface of the movable treating solution tank, the surface of the cloth guide drum, etc.; and its modifications. The operation of exchanging the treating solutions during the continuous treatment of a cloth can be done in a rapid and effective manner with a minimum loss of the treating solution.

6 Claims, 4 Drawing Figures

APPARATUS FOR APPLYING TREATING SOLUTION TO A CLOTH IN CONTINUOUS TREATMENT OF THE CLOTH

BACKGROUND OF THE INVENTION

1. Field of the Invention

The present invention relates to an apparatus by which during the continuous treatment of a cloth, a treating solution is applied thereto and the operation of exchanging the treating solutions can be done in a rapid and effective manner with a minimum loss of the treating solution.

2. Description of the Prior Arts

In subjecting a long, commercially produced cloth to such treatments as pretreatment and dyeing continuously, the first step is to soak the cloth with a treating solution (for instance, a caustic alkali solution in pretreatment and a dye solution in dyeing). This is usually done with the use of a treating solution tank. The cloth is then wet-heat treated in a steamer under either the ordinary atmospheric pressure or an elevated pressure.

In the continuous treatment of a long cloth, it is often required to subject the cloth to a foreign body or a different color treatment for each prescribed length of cloth. The color treatment involves the dyeing of each of said long cloths, a different color, depending on the prescribed length of the cloth itself. However, with such a color dyeing process, each time the dye solution is exchanged in the treating solution tank, the transportation of the cloth through the treating solution tank and, accordingly in the steamer, must be interrupted for the purpose of washing said treating solution tank. The operation is then reopened after a new dye solution is charged into the treating solution tank. During the course of interrupting and reopening the operation, the wet-heat treating condition of the interior of the steamer body changes frequently and accordingly it is impossible to carry out a uniform dyeing process of a long cloth. The interruption of the operation also causes a reduction in productivity. The conventional treating solution tank is usually of a U-shaped in its cross section and has a cloth guide roller provided therein for the purpose of transporting the cloth. The cloth soaked with the treating solution therein is squeezed with the use of a squeeze roller used for controlling the amount of treating solution which adheres to the cloth. Since there is usually a large space between the wall of the treating solution tank and the cloth guide roller provided therein, a large amount of the treating solution is left over in the tank as a result of the process of the treating solution. The remaining treating solution therefore, must be unavoidably abandoned, and is thus, uneconomical.

SUMMARY OF THE INVENTION

Under such circumstances, the object of the present invention is to offer an apparatus of which during the continuous treatment of a cloth onto which a treating solution is applied, the exchange of the treating solutions in a treating solution tank can be done in a rapid and effective manner with without interrupting the transportation of the cloth therethrough and in which the space of the treating solution tank is possibly made narrower for preventing a loss of the treating solution during the solution exchange process.

The principle of the inventive apparatus comprises providing a cloth guide drum for transporting the cloth to be treated and a movable treating solution tank positioned in close proximity to the circumference of the lower half of the cloth guide drum thus forming a narrow gap therebetween and serving as a cloth passage and a treating solution tank. The object of the invention can thus be attained.

DETAILED DESCRIPTION OF THE INVENTION

The present invention will be described in detail in the following with reference to the accompanying drawings showing examples of the inventive apparatus.

Figure 1:
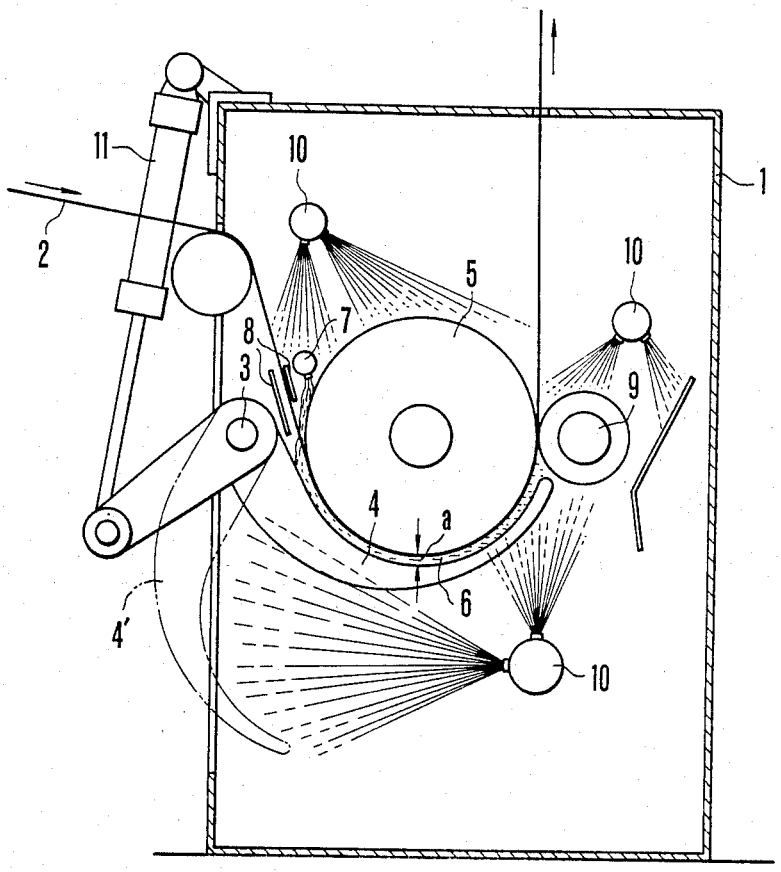
FIG. 1 shows an example of the present inventive apparatus for applying a treating solution to a cloth.

In FIG. 1, 1 shows the outer wall of an apparatus for applying a treating solution to the cloth continuously, and 2 is the cloth to be treated. In the interior of the outer wall 1, a movable treating solution tank 4, of a nearly semi-circular shape in its side section and freely rotatable by means of a shaft 3, and a cloth guide drum, 5, corresponding to this movable treating solution tank are provided for forming a gap "a" with a width of 2 to 5 mm therebetween thus serving as the cloth passage 6. 7 is a treating solution supply pipe for continuously pouring a treating solution into the cloth passage, 6, at a constant rate. 8 is a foam-extinguishing plate provided near the inlet of the cloth passage 6. 9 is a squeeze roller in contact with the cloth guide drum 5 at a position near the outlet of the cloth passage 6. 10 represents water jet nozzles provided at suitable positions on the outer wall 1 of the apparatus for washing the inner surface of the movable treating solution tank 4, the outer circumference of the cloth guide drum 5, the surface of the squeeze roller 9, etc. effectively. Finally, 11 is a cylinder for rotating the movable treating solution tank 4 from the normal position 4 to the opened position 4'.

The construction of an example of the present inventive apparatus for applying a treating solution to a cloth in the continuous treatment thereof shown in FIG. 1 is as above described. This apparatus for applying a treating solution to a cloth is provided outside of a steamer body (not shown in the drawing) for the continuous wet-heat treatment of a cloth. The cloth, 2, soaked with the treating solution in this apparatus is continuously fed through the steamer body and wet-heat treated therein.

The process for applying a treating solution to a cloth continuously through the use of this apparatus will now be illustrated in the following. By pushing out the piston of the cylinder 11, the movable treating solution tank 4 takes the position as shown with a solid line in FIG. 1 forming a cloth passage 6 in a circular arc shape between the tank 4 and the guide drum 5. In transporting a long cloth 2 continuously through the cloth passage 6, while supplying a treating solution such as a dye solution thereto, out of the treating solution supply pipe 7, and into the cloth passage at a constant rate, the treating solution in the cloth passage 6 is absorbed continuously by the cloth 2. The amount of treating solution supplied to the cloth passage 6 is controlled so as to correspond to the amount of the solution absorbed by the cloth, and thus the cloth is always soaked effectively with a fresh treating solution. The cloth soaked with a treating solution in this way is sufficiently squeezed with the use of the squeeze roller 9, in contact with the cloth guide drum 5, and then transported continuously through the steamer body (not shown in the drawing) for the wet-heat treatment thereof.

In exchanging the treating solutions in the movable treating solution tank 4, the cylinder 11 operates so that the movable treating solution tank 4 takes the position 4', as shown with a chain line in the drawing, and the treating solution remaining in the tank is discharged. Since the gap "a" between the treating solution tank 4 and the cloth guide drum 5 or the volume of the cloth passage 6 is set up to be as small as possible in a range by which the transportation of the cloth is not hindered, the amount of the treating solution to be discarded in this instance is very small. Then, wash water is propelled from each of the wash-water jet nozzles 10 to the movable treating solution tank 4, the cloth guide drum 5, the squeeze roller 9 etc. for the purpose of effectively carrying out the washing of the necessary parts of the apparatus in a very short period of time. There is no need for stopping the transportation of the cloth 2 during the washing operation.

After the washing of the apparatus is completed for applying the treating solution, the movable treating solution tank 4 is closed in the normal position for once again forming the cloth passage 6, and a new treating solution such as a dye solution of a different type is supplied from the treating solution supply pipe 7 and into the cloth passage 6. The application of this new type of treating solution to the cloth and accordingly, the wet heat treatment thereof can continuously be done in this way.

In this example, the gap "a" between the treating solution tank 4 and the cloth guide drum 5 is established in the range from 2 to 5 mm for making the volume of the cloth passage 6 as small as possible and for eliminating the problem of the useless loss of treating solution during the solution exchange process. However, since the cloth 2 is transported while one side of the cloth is in direct contact with the cloth guide drum 5, in some instances, depending on the type of cloth and the nature of the treating solution, said side of the cloth is not sufficiently soaked with the treating solution.

Figure 2:
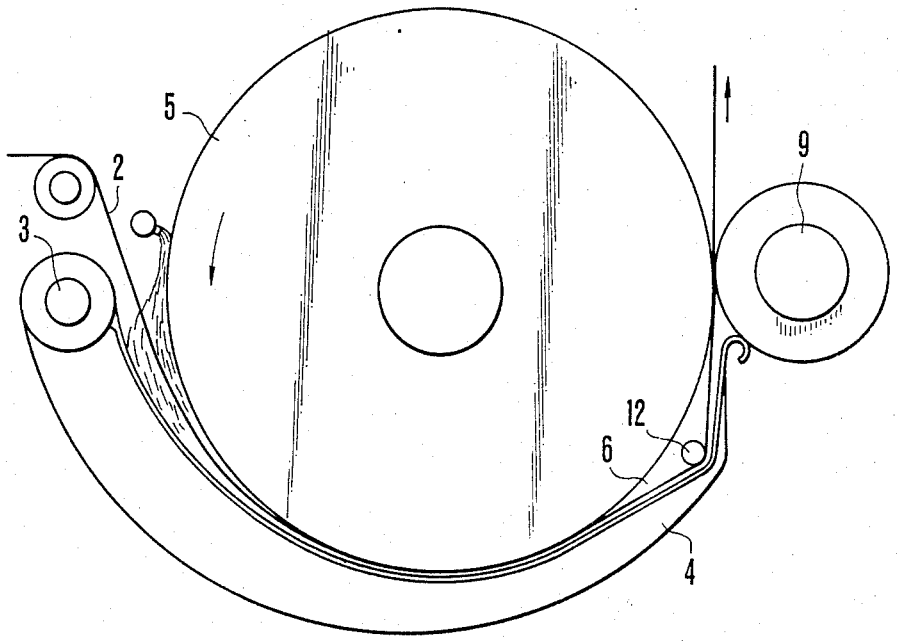
FIG. 2 is a side view of the essential part of a modification of the apparatus in FIG. 1.

It is advisable in such instances to use a modification of the apparatus in which a cloth guide roller 12 is provided in the cloth passage 6 for releasing the contact between the cloth 2 and the guide drum 5 partially as shown in FIG. 2. Both sides of a cloth can therefore be sufficiently and uniformly soaked with a treating solution, continuously.

Figure 4:
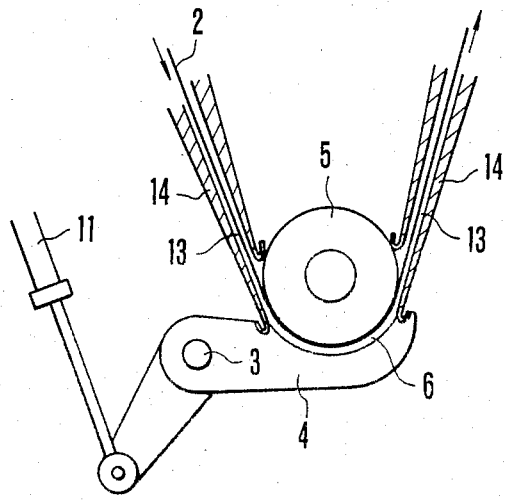
FIG. 4 is a side view of the essential part of the apparatus in FIG. 3.
Figure 3:
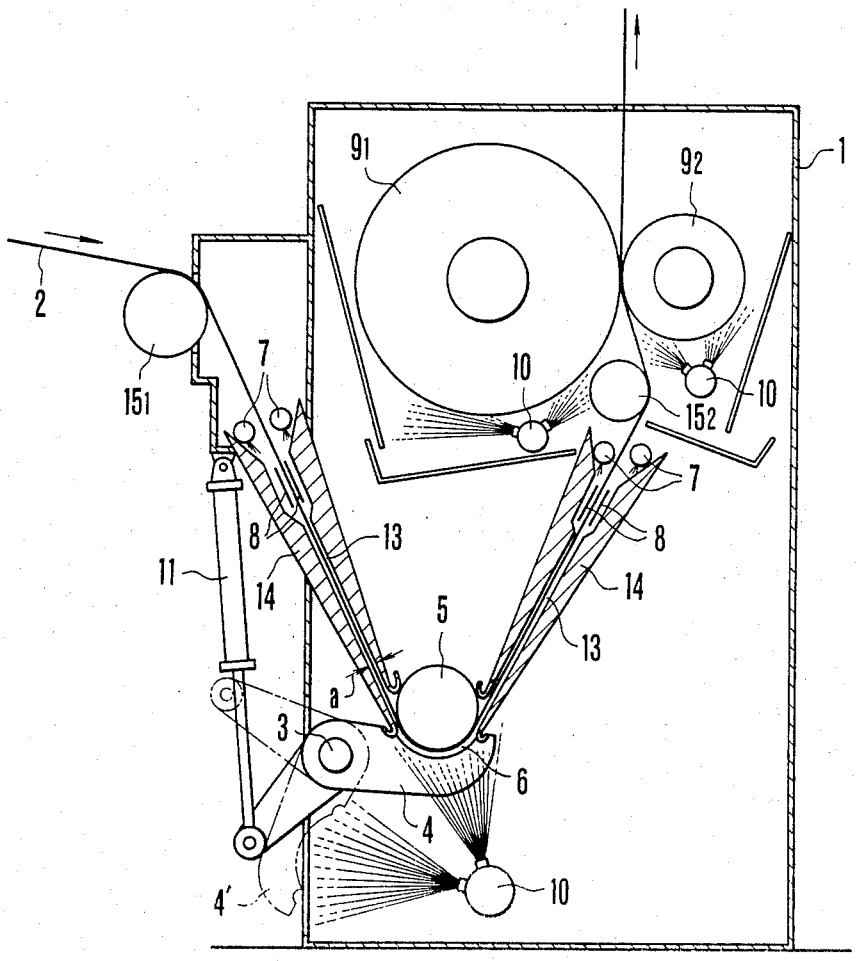
FIG. 3 is to show another modification of the apparatus in FIG. 1.

Another modification of the apparatus shown in FIGS. 3 and 4 is for prolonging the contact time of the treating solution to a cloth to be treated. In this modification, the narrow-width cloth passage 6 formed between the movable treating solution tank 4 and the cloth guide drum 5 in FIG. 1 is lengthened, as shown in FIG. 3, toward both the right and left sides thereof, in the upward direction forming a nearly V-shaped cloth passage 13, which simultaneously serves as a treating solution passage with the aid of a pair of cloth passage frames 14. It is so equipped that the cloth passage frames 14 are in contact with the treating solution tank 4 and the cloth guide drum 5 in a water-tight arrangement, and further that the cloth does not come in contact with the cloth passage frames 14 while passing through the cloth passage 13 with the provision of cloth guide rollers $\mathbf{15}_1$ and $\mathbf{15}_2$ as shown specifically in FIG. 4. $\mathbf{9}_1$ and $\mathbf{9}_2$ are squeeze rollers in contact with each other for squeezing the excess of the treating solution from the cloth. Other parts of the apparatus are the same as in FIG. 1.

In this example, the design is such that the total length of the cloth passage (6+13) is 500 mm and its width "a" is 3 mm. It is desirable from the result of this experiments that the total length of the cloth passage is in the range from 400 to 1000 mm and its width, 2 to 5 mm. Since the total length of the cloth passage is equipped to be sufficiently long enough for prolonging the contact time between the cloth and the treating solution therein, the cloth can be soaked sufficiently and uniformly with the treating solution. The exchange of the treating solutions can also be done smoothly and effectively as in the preceding case.

As described in detail in the above, in the present invention, the volume of treating solution in the cloth passage can be made small, and consequently, the treating solution supplied into the cloth passage can be almost completely absorbed by the cloth leaving only a small amount of the solution. Therefore, loss of the treating solution during the exchange process can be sufficiently avoided, and also the problem of public pollution caused by the discharge of the treating solution can be prevented.

Furthermore, in the present invention, as a result of the release of the movable treating solution tank due to the action of the cylinder 11 and the jetting effect of the wash-water, washing of the interior of the treating solution tank, the cloth passage, etc. can be done in a rapid and effective manner. Therefore, it is possible to exchange the treating solutions without interrupting the treatment of the cloth while preventing loss of treatment solution, and thus in the present invention the application of a treating solution to a cloth in continuous treatment thereof can be done smoothly, effectively and economically.

What is claimed is:

1. An apparatus for applying a treating solution to a cloth in the continuous treatment thereof, comprising:

(a) a cloth guide drum for transporting and guiding a cloth to be treated;

(b) a movable treating solution tank provided in close proximity to the circumference of the lower half of the cloth guide drum thus forming a cloth passage of a narrow width therebetween;

(c) a cylinder for raising and lowering of the movable treating solution tank;

(d) a treating solution supply pipe for supplying a treating solution continuously to the cloth passage;

(e) a cloth guide roller provided in the cloth passage of a narrow-width, said guide roller located for partially releasing the contact between the cloth and the guide drum; and (f) wash-water jet nozzles for propelling wash water to at least the inner surface of said movable treating solution tank, the surface of said cloth guide drum, and the surface of said cloth guide roller.

2. An apparatus for applying a treating solution to a cloth according to claim 1, in which the total length of the cloth passage is from 400 to 1000 mm.

3. An apparatus for applying a treating solution to a cloth according to claim 1, in which the width of the cloth passage is from 2 to 5 mm.

4. An apparatus for applying a treating solution to a cloth in the continuous treatment thereof, comprising:

(a) a cloth guide drum for transporting and guiding a cloth to be treated;

(b) a movable treating solution tank provided in close proximity to the circumference of the lower half of the cloth guide drum thus forming a cloth passage of a narrow width therebetween;

(c) a cylinder for raising and lowering of the movable treating solution tank;

(d) a treating solution supply pipe for supplying a treating solution continuously to the cloth passage;

(e) means extending said cloth passage of a narrow width formed between the movable treating solution tank and the cloth guide drum toward both the right and left sides of said cloth passage in an upward direction, said means forming a nearly V-shaped extended cloth passage which serves simultaneously as a treating solution passage, said means comprising a pair of cloth passage frames on either side of said cloth passage; and (f) wash-water jet nozzles for propelling wash water to at least the inner surface of said movable treating solution tank, the surface of said cloth guide drum, and the surface of said V-shaped means extending said cloth passage.

5. An apparatus for applying a treating solution to a cloth according to claim 4, in which the width of the cloth passage is from 2 to 5 mm.

6. An apparatus for applying a treating solution to a cloth according to claim 4, in which the total length of the cloth passage is from 400 to 1000 mm.

* * * * *